US009816039B2

(12) United States Patent
Francisco et al.

(10) Patent No.: US 9,816,039 B2
(45) Date of Patent: Nov. 14, 2017

(54) UPGRADING HEAVY OILS BY SELECTIVE OXIDATION

(71) Applicants: Manuel A. Francisco, Phillipsburg, NJ (US); Thomas Francis Degnan, Jr., Philadelphia, PA (US); Colin L. Beswick, Lebanon, NJ (US); Ramanathan Sundararaman, Pearland, TX (US)

(72) Inventors: Manuel A. Francisco, Phillipsburg, NJ (US); Thomas Francis Degnan, Jr., Philadelphia, PA (US); Colin L. Beswick, Lebanon, NJ (US); Ramanathan Sundararaman, Pearland, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 155 days.

(21) Appl. No.: 14/810,130

(22) Filed: Jul. 27, 2015

(65) Prior Publication Data

US 2016/0060550 A1 Mar. 3, 2016

Related U.S. Application Data

(60) Provisional application No. 62/041,828, filed on Aug. 26, 2014.

(51) Int. Cl.

| | |
|---|---|
| ***C10G 67/12*** | (2006.01) |
| ***C10G 55/06*** | (2006.01) |
| ***C10G 55/04*** | (2006.01) |
| ***C10G 27/04*** | (2006.01) |
| ***C10G 27/12*** | (2006.01) |

(52) U.S. Cl.

CPC ..... *C10G 67/12* (2013.01); *C10G 27/04* (2013.01); *C10G 27/12* (2013.01); *C10G 55/04* (2013.01); *C10G 55/06* (2013.01); *C10G 2300/1033* (2013.01); *C10G 2300/1077* (2013.01); *C10G 2300/1096* (2013.01)

(58) Field of Classification Search

CPC ..... C10G 55/04; C10G 67/02

See application file for complete search history.

(56) References Cited

PUBLICATIONS

Ewa Nowicka, Selective Oxidation of Polynuclear Aromatic Hydrocarbons, Jul. 2012, i-18.*

(Continued)

*Primary Examiner* — Randy Boyer
*Assistant Examiner* — Juan Valencia
(74) *Attorney, Agent, or Firm* — Chad A. Guice

(57) ABSTRACT

A heavy petroleum oil feed is upgraded by having its amenability to cracking improved by subjecting the oil to selective partial oxidation with a catalytic oxidation system to partially oxidize aromatic ring systems in the heavy oil. The partially oxidized oil can then be cracked in the conventional manner but at lower severities to lower molecular weight cracking products. The cracking following the partial oxidation step may be thermal in nature as by thermal cracking, delayed, contact or fluid coking or fluid catalytic cracking or hydrogenative as in hydrocracking.

18 Claims, 6 Drawing Sheets

(56) References Cited

PUBLICATIONS

Figure 1:
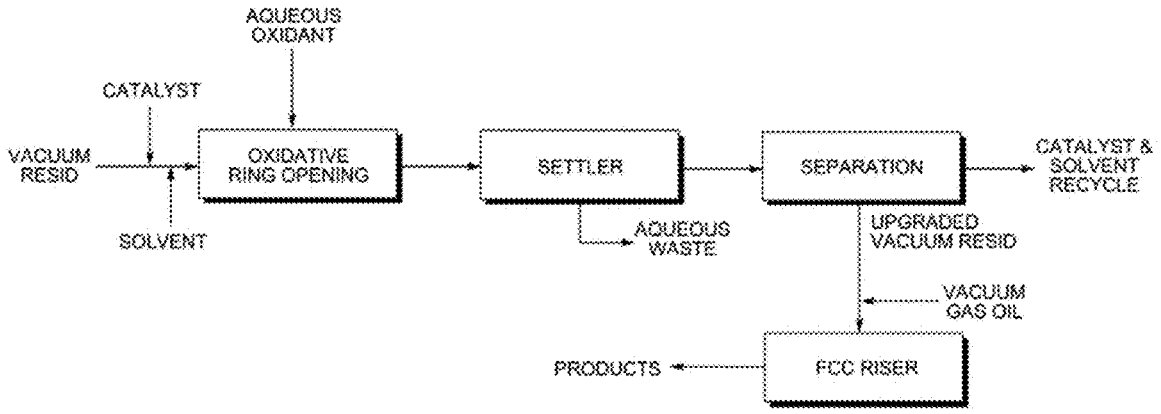

M. Anlai, Z. Sjuichang, Z. Dajlang, J. Zhijun, M. Xiaojuan and C. Qingtang, "Ruthenium-ion-catalyzed oxidation of asphaltenes and oil-source correlation of heavy oils from the Lunnan and Tahe oilfields in the Tarim Basin, NW China", Organic Geochemistry, vol. 39, Nov. 11, 2008, pp. 1502-1511.

C. Higman, "Perspectives and Experience with Partial Oxidation of Heavy Residues", presentation at the Table Ronde L'Hycirogene, Maillon Essential du Raffinage de Domain L'Association Franciase des Techniques du Petrol, Paris, Jun. 28, 1994.

Y.-G. Huang, Z.-M. Zong, Z.-S. Yao, Y.-X. Zheng, J. Mou, G.-F. Liu, J.-P. Cao, M.-J. Ding, K.-Y. Cai, F. Wang, W. Zhao, Z.-L. Xia, L. Wu and X.-Y. Wei, "Ruthenlum Ion-Catalyzed Oxidation of Shenfu Coal and Its Residues", Energy & Fuels, 2008, vol. 22, pp. 1799-1806.

L.M. Stock ande S.-H. Wang, "Ruthenium tetroxide catalysed oxidation of Illinois No. 6 coal", Fuel, 1985, vol. 64, pp. 1713-1717.

* cited by examiner

UPGRADING HEAVY OILS BY SELECTIVE OXIDATION

CROSS-REFERENCE TO RELATED APPLICATIONS

This application claims priority to U.S. Provisional Application Ser. No. 62/041,828 filed Aug. 26, 2014, herein incorporated by reference in its entirety.

FIELD OF THE INVENTION

The present invention relates to a method of upgrading heavy oils, including heavy crudes, reduced crudes, residual oils from distillation processes and bitumens.

BACKGROUND OF THE INVENTION

Heavy oils, including heavy crudes, reduced crudes, residual oils from distillation processes and bitumens, are relatively low value products and unsuitable for many of the purposes for which lighter hydrocarbon products can be practically used. To exploit these materials more fully, a multiplicity of refining processes have been developed and used. These refining processes are all based upon the recognition that as the boiling point of the hydrocarbons in petroleum increases, the hydrogen:carbon ration decreases. Conceptually, therefore, heavy oil upgrading processes function either by rejecting carbon or by adding hydrogen. Typical carbon rejection processes include thermal cracking processes such as visbreaking (a mild thermal cracking) and the various coking processes including delayed coking, fluid coking and continuous coking where the degree of severity is much greater. In the coking processes, a substantial proportion of the heavy oil feed is converted to coke as a by-product of the cracking mechanism with its rejection of carbon. In a typical delayed coking process, for example, the yield of $C_5$+ liquids may be about 55 percent of the feed by weight with rather better conversion to the desirable hydrocarbon liquids from fluid coking processes including Flexicoking™, the proprietary fluid coking process developed by Exxon Research and Engineering which uses the excess coke by-product to generate fuel gas for use in the refinery. The dominant current commercial practice is to employ the coker as a standalone unit for converting resids but coking, as a carbon rejection process, inevitably results in the formation of significant quantities of low value petroleum coke as a by-product along with some heavy fuel oil which is undesirable.

Another widely used carbon rejection process is catalytic cracking, now used almost universally in the form of Fluid Catalytic Cracking (FCC); in this process the carbon which is rejected as coke onto the cracking catalyst is consumed during oxidative regeneration of the catalyst to provide heat for the endothermic cracking of the feed with the ultimate rejection of the carbon as carbon dioxide in the regenerator effluent gas.

Hydrogen addition, on the other hand, is carried out in the hydrocracking process in which the heavy oil feed is subjected to high temperature in the presence of hydrogen under high pressures which result in cracking of the molecules in the feed with opening of the aromatic rings to permit the hydrogen to combine with the cracking fragments. The hydrocracking reactions proceed in the presence of a catalyst, typically a bifunctional material with both cracking and hydrogenation/dehydrogenation functionality. Reaction mechanisms during hydrocracking may include initial dehydrogenation to species with a higher cracking rate followed by hydrogenation as ring opening of the aromatic species proceeds.

Using FCC as a standalone process for resid conversion is not feasible because of the high metal content and excessive coke forming nature of the resid. But there is an incentive to process resid in the FCC as it can effectively utilize the spare FCC capacity brought about by the diminished gasoline demand. The current approach for upgrading resids (removing metals and reducing CCR) before sending it to a FCC is by fixed bed hydroprocessing, where resid is treated in a series of reactors (three or more) that operates at temperatures ranging between about 350 and 425° C. (about 660 to 830° F.) and a hydrogen pressure that ranges between 10,000 and 20,000 kPag (about 1450-2900 psig) making it a capital intensive process. in addition, its high hydrogen consumption leads to high operating costs and, in addition, the capability of fixed bed hydroprocessing is generally limited to resids containing up to 100 ppm metals because of their deleterious effect on catalyst life.

The highest boiling components of heavy oils typically comprise multi-ring aromatics with side chains of varying length depending on the prior processing. The bottoms products from the catalytic cracking process are typically highly aromatic, having lost most of the side chains which are removed during the cracking process. In all cases, however, heavy oils, the term used here to encompass oils of petroleum origin of high boiling point e.g. above about 540° C., and typically low API gravity below about 20, e.g. below 8 or 10, as well as non-distillable residual fractions from atmospheric and vacuum distillation as well as bitumens and tar sand heavy oils, are highly aromatic with high concentrations of aromatics with 4 fused rings or created (designated here as ≥4Rs) which are responsible for the formation of the low value coke by-product during the coking process and the need for significant amounts of high pressure hydrogen during hydrocracking.

The mass lost in coking is attributed to aromatics in the feeds that have critically large, nonvolatile, aromatic cores (≥4 fused aromatic rings, ≥4R). These same aromatics are difficult to hydrocrack down to ≤3Rs and overcracking tends to occur to form hydrocarbon gas. This does not represent an efficient use of the expensive high pressure hydrogen used in the process. The major reason for this is that ≥4Rs are electron rich and difficult to reduce further and given that hydrocracking is a reduction, there is considerable difficulty in selectively hydrocracking the ≥4Rs to species that can more easily be hydrogenated even in the presence of high pressure hydrogen and active catalysts.

A new process chemistry that converts ≥4Rs to ≤3Rs without the use of high pressure hydrogen would be of significant value to heavy oil upgrading, whether by coking or hydrocracking since it is the aromatics with the more highly fused ring systems (≥4Rs) which are refractory to both thermal and hydrogenative cracking conditions.

SUMMARY OF THE INVENTION

We have found that it is possible to upgrade petroleum resids by a process of oxidative ring opening (ORO) prior to processing in a process resulting in a bulk boiling range reduction (cracking). Thus, the ORO process provides a useful pre-treatment for residual feeds to be cracked in hydrogen addition (hydrocracking) processes as well as by carbon rejection processes including FCC (including Resid Catalytic Cracking—RCC or RFCC) and thermal cracking processes such as coking (e.g. delayed coking, fluid coking and Flexicoking) and visbreaking. The oxidative ring opening process acts by removing metals and converting coke formers, principally 4- and 3-ring aromatics, to 1- or 2-ring aromatics with oxygen functionalities which are more amenable to boiling range reduction. Oxidative ring opening provides a particularly useful means for refilling the FCC unit capacity with resid rather than purchased gas oil and in cokers can also potentially reduce coke formation and help to reduce the amount of coker gas oil, resulting in increased distillate production Thus integrating ORO with refinery processes can be of great value.

We have identified chemistry which selectively oxidizes aromatic carbon in preference to aliphatic under mild conditions, The oxidative ring opening (ORO) process according to the invention upgrades resids under mild conditions, typically at relatively low temperatures, below about 150° C. (≤300° F.) and normally close to ambient pressure, below about 30 kPag (<50 psig) with an oxidation catalyst (e.g., $H_2WO_4$ or $RuO_4$) using an oxidant such as hydrogen peroxide or bleach (hypochlorite) to convert multi ring fused aromatics to 1 or 2 aromatic rings with oxygen moieties along with simultaneous metal removal. Unlike commercial fixed bed hydroprocessing, ORO is not limited by metal content of the resid as metals are extracted in to the aqueous phase; this makes it an attractive alternative to process even extra-heavy resids with high metal contents. The operating conditions of ORO makes it a lower cost route for upgrading resids.

According to the present invention, therefore, a heavy petroleum oil feed is upgraded by having its amenability to cracking improved by subjecting the oil to selective partial oxidation with an oxidation system comprising a catalyst and an oxidant to partially oxidize aromatic ring systems in the heavy oil. With the crackability improved by this treatment, the partially oxidized oil can then be cracked in the conventional manner but at lower severities to lower molecular weight cracking products. The cracking following the partial oxidation step may be thermal in nature as by thermal cracking, delayed, contact or fluid coking or fluid catalytic cracking or hydrogenative as in hydrocracking.

A preferred and highly effective oxidation system is provided by the ruthenium catalyzed oxidation with sodium periodate as the stoichiometric oxidant. We have found that the chemistry of this system known as RICO (ruthenium, iodate catalyzed oxidation) oxidizes ≥4R aromatics faster than ≤3R since the electron rich aromatics in the ≥4R aromatics are more suited to react readily with oxygen under less energetic conditions. In this way, the refractory aromatics in the heavy oils may be concerted to products which are more amenable to upgrading to products with higher hydrogen:carbon ratios by conventional processing under less forcing conditions.

The opportunity for selectivity is good when the degree of oxidation is controlled; this can be achieved by limiting the amount of oxidant or, when required, by the use of reducing agents which quench the reaction and stop it. The RICO chemistry is known and has previously been used to characterize alkyl groups bound to aromatics in coal molecules and petroleum asphaltenes by oxidizing all the aromatic carbon to $CO_2$ and $H_2O$ as well as to partially oxidize petroleum asphaltenes, heavy oils, resids and bitumens but has not been proposed for upgrading heavy oils, resids and bitumens and there has been no indication that the oxidations changed the coking properties of the materials.

We have demonstrated the selectivity and potential of the RICO chemistry to convert ≥4R aromatics to ≤3R aromatics and therefore the applicability of using this process as a pretreatment for coking or hydrotreatment. The conversion of all or a substantial proportion of the ≥4R aromatics in heavy oils, resids and bitumens removes the propensity of these feeds to produce coke and the oxidation product is more easily hydrocracked with a reduced degree of reliance on high pressure hydrogen and a risk of overcracking.

DRAWINGS

In the accompanying drawings:

FIG. 1 is a simplified process schematic for the present oxidative ring opening process, and FIGS. 2 to 6 are graphical representations of the results achieved in the experiments described in the Examples below.

DETAILED DESCRIPTION

Heavy Oils

The present process is applicable to the upgrading of heavy oils which term is used here to mean oils of petroleum origin of high boiling point e.g. above about 540° C. for vacuum resids, and typically low API gravity below about 20, for instance, below 15 or even lower, e.g. 5, 8 or 10, and a Conradson Carbon Residue (OCR) content typically from 0 to 40 weight percent. The term is used here to apply to non-distillable residual fractions from atmospheric and vacuum distillation, heavy whole crudes, reduced crudes, visbroken resids, deasphalter bottoms, or FCC bottoms as well as bitumens and tar sand oil (the term "tar sand" is used here to refer to the deposits known as tar sand, bitumen sand and oil sand), shale oils, oils from heavy oils such as the crudes from the tar sand belt in Venezuela, especially the Orinoco Tar Belt and the Cerro Negro part of the belt. Other heavy crude sources include tar sands such as the tar sands, tar pits and pitch lakes of Canada (Athabasca, Alta.), Trinidad, Southern California (La Brea (Los Angeles), McKittrick (Bakersfield, Calif.), Carpinteria (Santa Barbara County, Calif.), Lake Bermudez (Venezuela) and similar deposits in Texas, Peru, Iran, Russia and Poland. The crudes from these oilfields are generally characterized by a low API gravity (low hydrogen content), typically in the range of 5-20° API and in many cases from 6 to 15° with some ranging from 8 to 12° API. Specific examples include the 8.5° API Cerro Negro Bitumen and crudes from the Morichal (8-8.5° API), Jobo (8-9° API), Pilon (13° API ) and Temblador (19'API) oilfields. These extra-heavy oils are normally produced by conventional enhanced recovery methods including alternated steam soaking. The heaviest types of these oils such as the Morichal arid Jobo crudes are normally diluted at the well-head with gasoil or lighter crudes or processed petroleum fractions such as heavy naphthas, distillates or thermal cracking products including coker gas oils and coker naphthas, in order to reduce their high viscosity and facilitate their transport by pipeline and to attain their sale specification as synthetic crudes, for instance, as the commercial blend known as the Morichal Segregatio (12.5° API) or the blend of Non and Temblador sold as Pilon Segregation (13.5° API ) or the Non blend in which all the crudes produced from the region are diluted to 17° API with lighter crudes from the adjacent San Tome area. In addition, coal liquids including coke oven liquids, tars from deasphalting units or combinations of these and other materials with comparable properties are appropriately considered to be heavy oils. In all cases, these are high viscosity petroleum fractions of low mobility under normal conditions and which may require heating or dissolution in solvent for further processing.

Petroleum residua ("resid") feedstocks are suitable for treatment by the present process. Petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude that would tend to deactivate hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking catalysts.

The present oxidative ring opening process is particularly useful with residual (non-distillable) fractions; while the process is particularly useful with vacuum resids (fractions boiling above about 540° C. or higher), it may also be applied to the treatment of atmospheric resids (fractions generally boiling above 380° C.) but in most cases the atmospheric resids will be subjected to vacuum distillation in order to remove valuable components before the vacuum resid is treated by the ORO process. As noted above, bitumen, shale oils, tar sand oils and other high boiling petroleum fractions are amenable to treatment by the present process.

Controlled Oxidation Process

The heavy oils are subjected to treatment by controlled partial oxidation to effect ring opening, preferably to an extent that results in the ≥4R aromatics being converted to a significant degree to ≤3R aromatics so that subsequent upgrading to products with higher hydrogen:carbon ratios may be carried out under acceptably mild conditions. Preferably, the 3R aromatics are also converted to 1- or 2-ring aromatics for improved crackability.

The oxidative ring opening catalyst and oxidant serves to selectively open multi-ring, fused ring aromatics by selective oxidation—no hydrogen is required: The process is preferentially selective in opening the aromatic rings of molecules with 5-fused aromatic rings, then 4-fused rings, then 3-fused rings. It is desirable to treat the resid so that a majority of the 5-ring, 4-ring, and 3-ring aromatics are transformed into 1- and 2-ring aromatics containing alkyl-side chains with oxygen moieties (e.g., ethers, aldehydes, ketones and carboxylic acid groups). This oxidative ring opening (ORO) treatment has also been shown to dramatically reduce the level of metals in the resid; these are rejected into the aqueous waste stream following the oxidation.

In this treatment, the heavy oil starting material is subjected to oxidation with a stoichiometric oxidizing agent in the presence of a catalyst. Suitable oxidants include salts such as hypochlorites (—OCl), peroxy acid salts such as percarbonates, e.g. sodium percarbonate, potassium permanganate, perchlorates such as sodium perchlorate, persulfates such as sodium persulfate, periodates such as sodium periodate, as well as hydrogen peroxide ($H_2O_2$) and oxygen ($O_2$); sodium hypochlorite (NaOCl-bleach) is particularly preferred as being inexpensive while surprisingly effective under the present mild conditions. Hypochlorite solutions of up to 40% wt. pct. concentration are commercially available and will generally be effective although lower concentrations may also suitable, e.g. from 5 to 20 wt. pct. hypochlorite. Hydrogen peroxide in 10-20% v/v concentration will be suitable but highly concentrated solutions ("high test peroxide") should be avoided for reasons of safety as should other strong and potentially unstable oxidants. The oxidation may be carried out by passing air or air enriched with oxygen through the heated resid with agitation which may be supplied by the passage of the air to ensure good liquid/gas contact; pure oxygen, like concentrated peroxide should normally be avoided for the same reasons.

The use of liquid solution oxidants is preferred since the amount can be more easily regulated relative to the resid in order to prevent excessive reaction to form undesirable oxidation products. if necessary, the reaction can be quenched by the addition of a stoichiometric amount of a reducing agent (relative to the oxidant).

The catalysts used in the present process are generally classifiable as metal oxides or mixed oxides which may be regarded as acids or salts depending on their composition. Exemplary catalysts of this type include ruthenium tetroxide ($RuO_4$), tungstic acid ($H_2WO_4$) and ferric nitrate ($Fe(NO_3)_3$).

A particularly preferred oxidant/catalyst system comprises a periodate, typically sodium periodate, $NaIO_4$, as a stoichiometric oxidant in the presence of a ruthenium ion catalyst such as $RuO_4$. Because the periodate acts stoichiometrically, the extent of oxidation can be controlled if necessary by control of the amount of periodate relative to the amount of the heavy oil feed. If necessary, the reaction can be quenched by the addition of a stoichiometric amount of a reducing agent (relative to the periodate), preferably sodium sulfite ($Na_2SO_3$).

The presence of periodate ruthenium ions are converted to ruthenium tetroxide:

$$8Ru^{3+}(aq)+5IO_4^-(aq)+12H_2O(l)\rightarrow 8RuO_4(s)+5I^-(aq)+24H^+(aq)$$

Many trivalent ruthenium compounds can be used as precursors to $RuO_4$, such as ruthenium (III) chloride. Complex anions of the metal may conveniently be used such as the salts of tetrapropylammonium perruthenate, $[N(C_3H_7)_4]RuO_4$. In the form of ruthenium tetroxide, oxidation of hydrocarbons proceeds readily under relatively mild reaction conditions, The typical oxidant is sodium periodate but other alkali metal periodates such as potassium periodate may be used if available.

The heavy oil is contacted with the oxidant system in a solvent to ensure mobility of the feed and adequate contact between the viscous feed and the catalyst. As the oxidation is selective for aromatic ring systems, aliphatic solvents such as hexane, octane, decane, dodecane, diesel oil and like materials should be used; halogenated and oxygenated aliphatic solvents may be used including, acetone, diethyl ketone, ethylmethyl ketone, carbon tetrachloride, dimethylformamide, chloroform, dichloromethane, liquid $CO_2$, acetonitrile, benzene, toluene, 1,2-dichloroethane, cyclohexane, diethylene glycol, diethyl ether, dimethylsulfoxide, ethyl acetate. While separation of the catalyst from the hydrocarbon can be more readily carried out with the catalyst and oxidant suspended in different phases, using an aqueous solution of the catalyst, a co-solvent, useful in effecting phase transfer of the catalyst and oxidant may be used (e.g., ethyl acetate) to increase the efficiency of the process.

High temperatures are neither necessary nor desirable in view of the potential for runaway reaction in the presence of the more concentrated oxidizing agents. In general, suitable temperatures will range from above ambient and sufficient to render the resid pumpable temperatures up to about 150° C. As noted above, pressures are also relatively low since the resids have relatively low vapor pressures and are, by definition, undistillable; typically the pressure will not exceed 30 kPag (<50 psig) although more volatile solvents may require higher pressures at higher temperatures in order to maintain operation in the liquid phase.

The conditions should, of course, be selected according to the oxidant/catalyst system in use with safety being a relevant factor. With the ruthenium tetroxide/periodate system, for example, the unstable nature of ruthenium tetroxide; ambient temperatures from about 10 to 25° C. are suitably preferred with pressures only as great as needed to maintain the solvent in the liquid phase, The use of solvent mixtures including a co-solvent for the solvent selected to dissolve the heavy oil reactant and the water solution of the ruthenium are desirable, for example, mixtures with acetonitrile which is reported to complex ruthenium ions and prevent their precipitation from the reaction mixture. See Stock et al, *Ruthenium Tetroxide Catalysed Oxidation of Illinois No. 6 Coal*, Fuel 64, Issue 12, 1985, 1713-1717.

The oxidation is affected on a stoichiometric basis by the oxidant and accordingly this component of the reaction system is used in amounts corresponding to the aromatic, taking into consideration its amount and the number of aromatic rings which are to be oxidized. In general, the amount necessary should be determined empirically, depending upon the desired reduction in severity for the subsequent processing, e.g. if a more severe hydrocracking or catalytic cracking can be accommodated, the degree of ring oxidation and the amount of oxidant can be correspondingly reduced. If the catalyst is regenerated by the oxidant back to the active form as is ruthenium tetroxide with periodate, it need be present only in catalytic amounts, typically from 0.1 to 5.0 weight percent of the aromatic feed or less, e.g. 0.1 to 1 weight percent of the feed.

The oxidation is conveniently carried out in a batch processing in which the heavy oil feed is reacted with the catalytic oxidant system over the requisite period of time in a controlled tankage; if a gaseous oxidant is used such as air, a continuous flow process may be used.

FIG. 1 is a simplified process flowsheet showing the principle elements of the process in relation to one another using, in this case, a vacuum resid as the feed and an aqueous oxidant such as hypochlorite. The resid feed enters the unit (from left) and is mixed with solvent and catalyst (recycled and makeup) before entering the oxidation reactor in which the oxidative ring opening reactions take place; the reactor is supplied separately with an aqueous oxidant solution, permitting ratios and concentrations of the oxidant to be regulated in accordance with the characteristics of the feed. An example of an ORO reactor would be a multistage liquid-liquid extraction column with reciprocating or rotating plates similar to a lube solvent extraction unit, in order to improve mixing between the viscous resid/solvent phase and the aqueous oxidant phase in order to favor interphase mass transfer. From the oxidation reactor, the effluent is taken to a settler permitting the hydrocarbon phase and the aqueous phase to separate into separate layers. The hydrocarbon layer with the solvent is separated from the aqueous layer and the upgraded residual fraction from the solvent in a subsequent separation step e.g. fractionator. The solvent may be recycled to the beginning of the process with regeneration if necessary; catalyst may be recovered from the aqueous phase from the settler, regenerated if necessary and recycled. The resid upgraded by ORO is sent to a FCC riser or other subsequent conversion process such as hydrocracking.

Processing of Oxidized Feed

The process stream comprising the upgraded heavy oil can be passed to subsequent processing steps which will normally be thermal or catalytic cracking. These can be carried out according to conventional methods which, being well established, require no further description here but typically, the selective oxidation will enable the processing to be carried out at lower severities than would otherwise be the case, i.e. in the absence of the oxidation. Thus, for example, thermal cracking as by delayed or fluid coking can be carried out with reduced furnace temperature, e.g. a reduction of 25-50° C. Hydrocracking may be carried out under lower hydrogen pressures, at lower temperatures or with higher space velocities, so increasing unit capacity without major capital expenditure. Catalytic cracking may be carried out at lower riser top temperatures, so making it possible to reduce pre-heat or to increase heavy oil feed rate relative to the catalyst circulation rate.

The upgraded resid by ORO makes it a feed which is particularly suitable for conversion in a FCC because of the reduced content of multi-ring, fused ring aromatics and total metal content in the oxidized resid. Conversion of majority of the 5-, 4-, and 3-ring aromatics by ORO into 1- and 2-ring aromatics containing alkyl side chains with oxygen moieties will help to reduce the amount of heavy fuel oil (HFO) and coke produced during the cracking, also to increase the yield of high value $C_2$-$C_4$ olefins and increase distillate volume from FCC. Metals removal from resid by ORO has beneficial effects on FCC too, including reduced catalyst consumption and avoidance of undesired selectivity in the presence of Ni and V.

EXAMPLE 1

Figure 2:
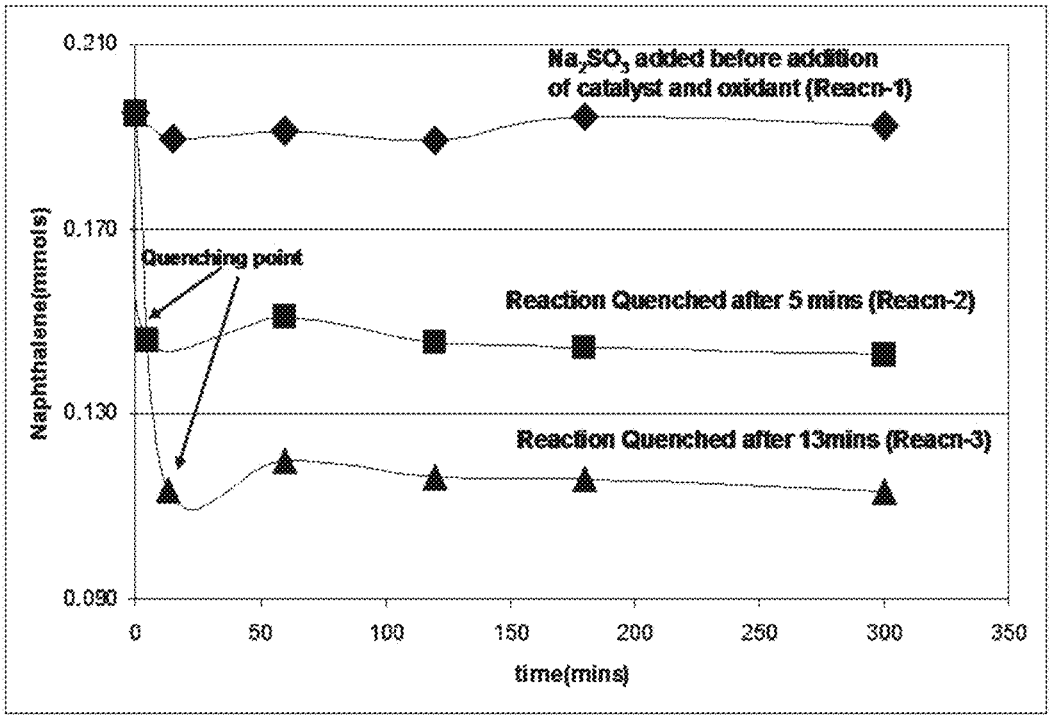
Figure 3:
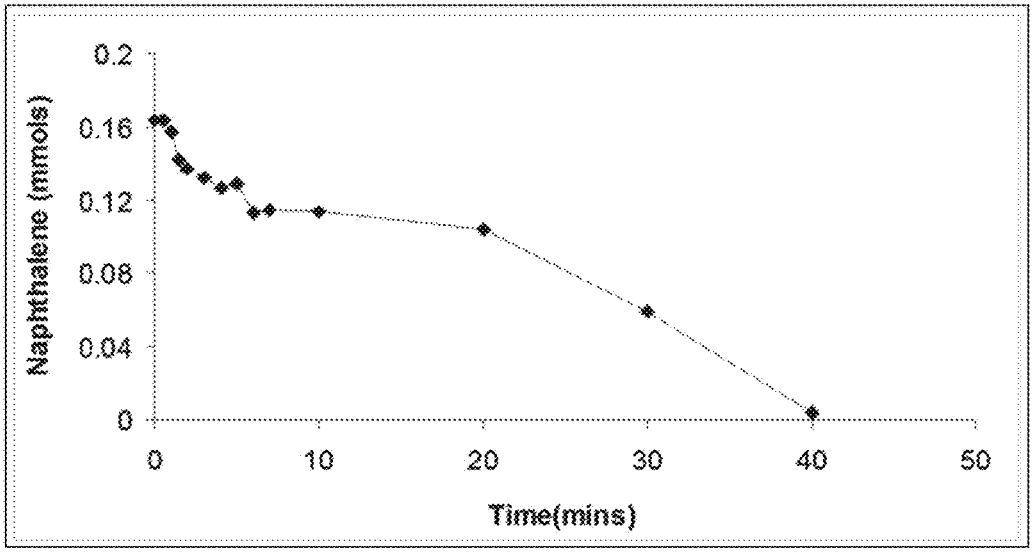

To demonstrate the effectiveness and controllability of the partial oxidation process on fused aromatic ring systems, naphthalene (0.100 g) was mixed in a water/acetonitrile solvent (10 ml/6 ml) and 0.010 g of ruthenium trichloride trihydrate was added together with 1.2 g sodium periodate In an initial run, sodium sulfite reductant was added before the ruthenium catalyst and periodate oxidant were added. In two later runs, the reductant was added after 5 minutes and 13 minutes respectively. The results are shown in FIG. 2 which plots the naphthalene concentration, determined, against time for the three runs: the reductant is effective to terminate the oxidation reaction. The oxidant (periodate) is inactive without the catalyst (ruthenium) and the catalyst is inactive without the oxidant. FIG. 3 is a GC-MS chromatogram which shows the concentration of naphthalene as a function of time during the oxidation reaction: the disappearance of the naphthalene is shown as the oxidation proceeds.

EXAMPLE 2

Figure 4:
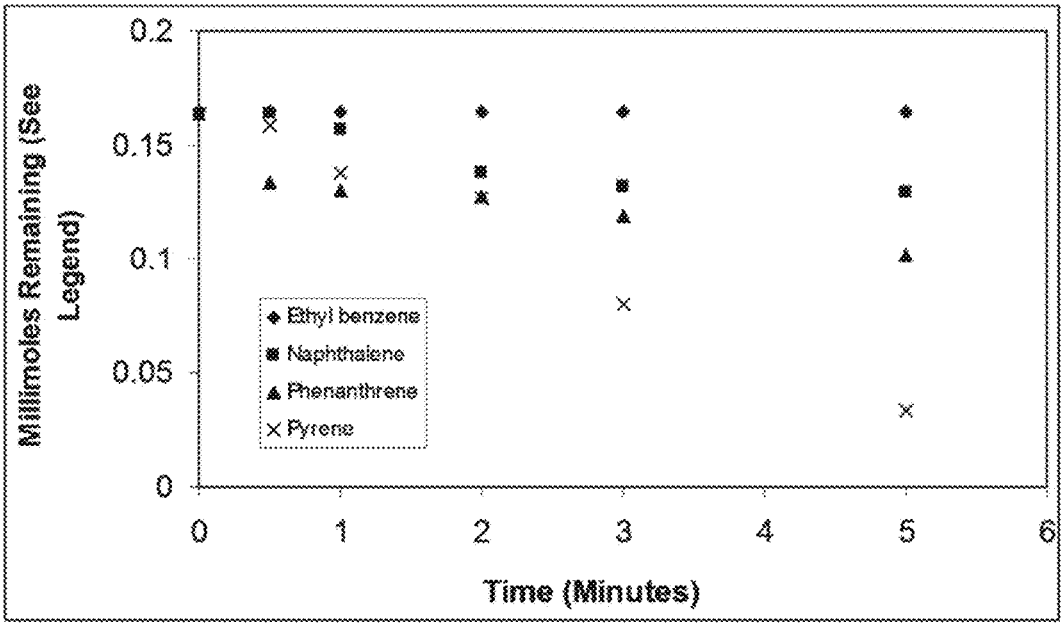
Figure 5:
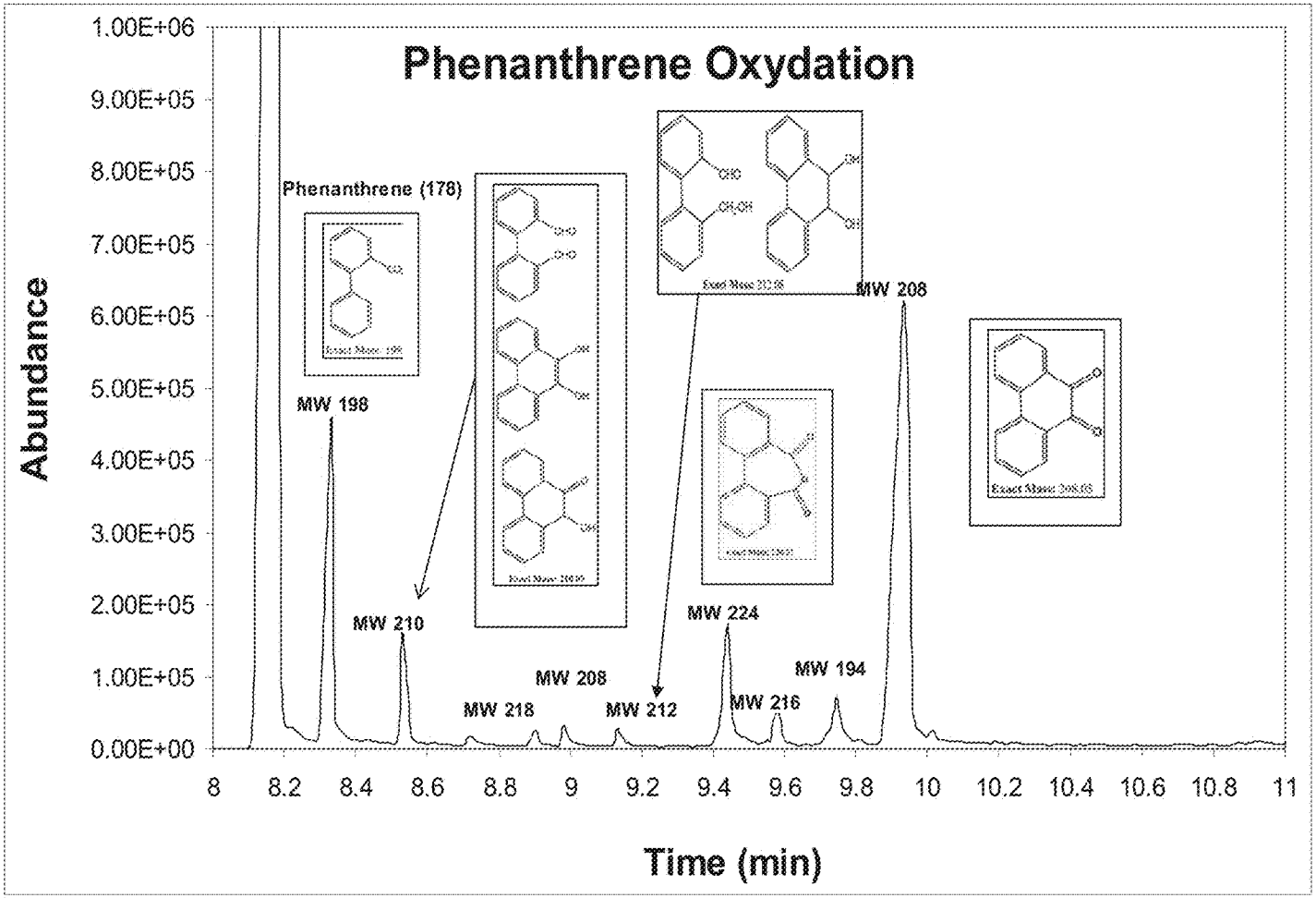
Figure 6:
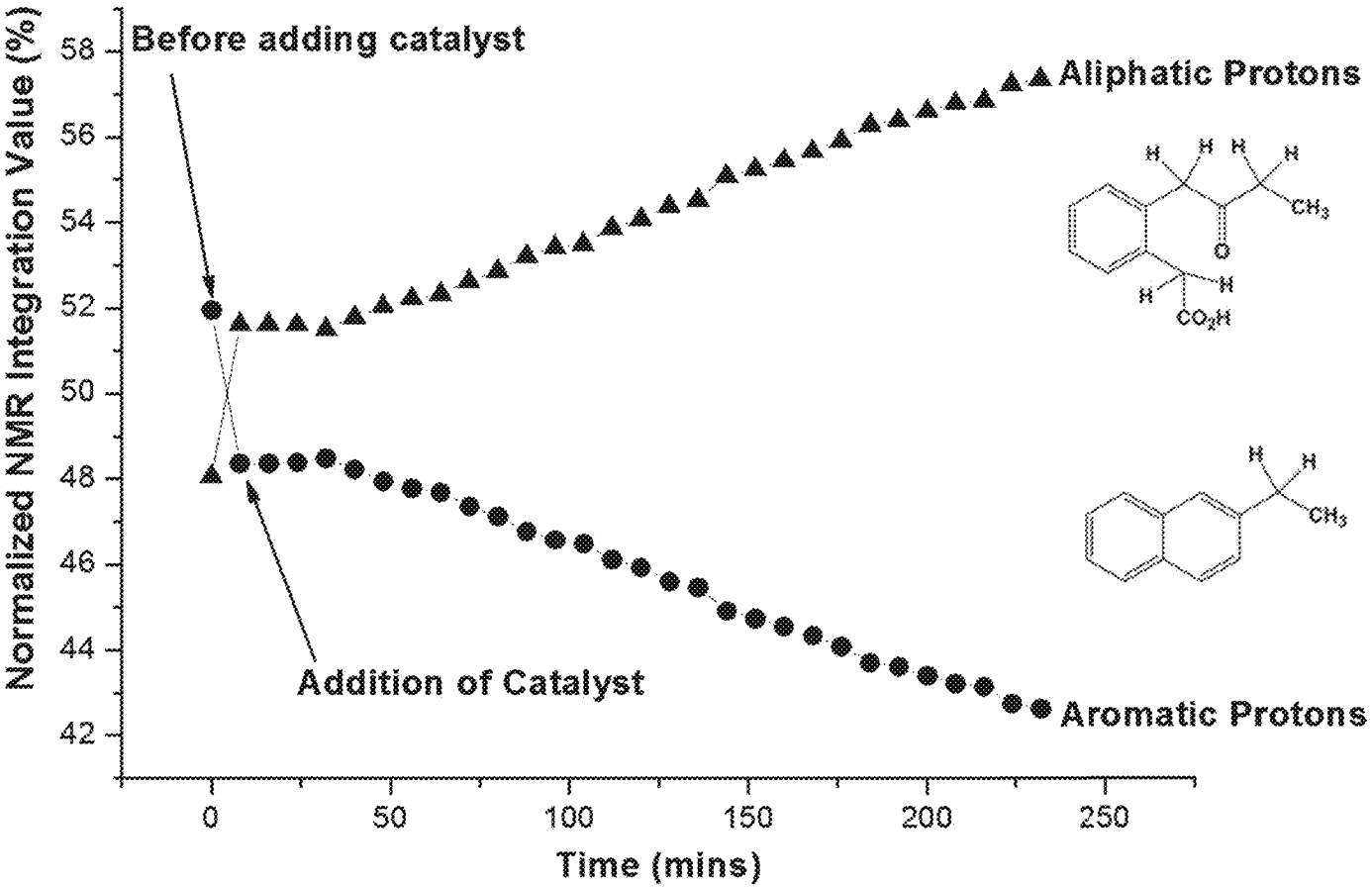

To demonstrate the selectivity of the oxidation on aromatic ring systems, four runs using the same oxidant/catalyst system as in Example 1 were made in the same mixed solvent. The aromatics used were ethylbenzene, naphthalene, phenanthrene and pyrene. The course of each reaction was plotted and the results are shown in FIG. 4.

The data demonstrate the selectivity of the chemistry which oxidizes aromatics according to the number of fused aromatic rings with the order of reactivity being 4R>3R>2R>1R even at longer reaction times with perylene (five fused rings) reacting as fast as pyrene (four rings).

EXAMPLE 3

The oxidation of phenanthrene carded out as in Example 2 was used to progress of the oxidation process on a fused multi-ring aromatic system. The course of the oxidation reaction with phenanthrene was monitored by GO-MS and the results shown in FIG. 5, indicating that the oxidation yields left over starting material and several oxidation products. The rings are oxidized and opened one ring at a time; the formation of the carbonyl and alkyl protons was corroborated by NMR.

EXAMPLE 4

2-Ethylnaphthalene was oxidized using the same oxidant/catalyst system in the same solvent as in Example 1 and the course of the reaction followed using $H^1$NMR to detect aromatic and aliphatic protons. It was found that new methylene and methyl hydrogens appear at 1.8 ppm with traces of olefinic hydrogen at 5.2 ppm. The results which are shown graphically in FIG. 6 were confirmed by separate experiment and further by the oxidation of ethylanthracene with comparable results.

EXAMPLE 5

The mass recovery on the phenanthrene oxidations was excellent as shown by the following Table 1 in which the product recovery is based on the amount of phenanthrene and the inorganics recovery is based on the total amount of $RuCl_3$, $NaIO_4$ and $Na_2SO_3$ added to the reaction:

TABLE 1

| Reaction # (minutes) | % Organic Product Recovery | % Inorganic Product Recovery |
|---|---|---|
| 1 (60) | 102 | 93 |
| 2 (10) | 111 | 116 |
| 3 (15) | 95 | 97 |
| 4 (30) | 98 | 102 |
| 5 (10) | 99 | 98 |
| 6 (30) | 95 | 101 |
| 7 (30) | 95 | 100 |

EXAMPLE 6

An Arab Light Vacuum Resid (ALVR) was subjected to a mild oxidation treatment with $H_2O_2/H_2WO_4$, and a severe oxidation using $RuO_4$/NaOCl. The elemental analyses of the starting resid and the oxidized products are shown below in Table 2.

TABLE 2

| Feed | ALVR | Mildly Ox-Resid | Severely Ox-Resid |
|---|---|---|---|
| Elemental Analysis, wt % | | | |
| C | 83.6 | 78.2 | 71.3 |
| H | 10 | 9.44 | 9.15 |
| S | 4.1 | 3.89 | 2.78 |
| N | 0.39 | 0.4 | 0.41 |

TABLE 2-continued

| Feed | ALVR | Mildly Ox-Resid | Severely Ox-Resid |
|---|---|---|---|
| O | 0.5 | 5.77 | 10.7 |
| Ni/V, ppm | 96.8/27.7 | 37/16 | 17/16 |
| NMR | | | |
| Aromatic/Aliphatic C | 31.2/68.8 | 31.1/68.9 | 15.8/82.5 |
| Aromatic/Aliphatic H | 6.7/93.3 | 6.5/93.5 | 4.2/95.8 |
| MCR, wt % | 24.3 | 29.3 | 31.5 |

From Table 2 it can be seen that the severe oxidation achieves a 73% Ni+V removal with a 30% S reduction and that the reduction in C is compensated by O addition. The C-aromaticity is reduced by 50%, and the H-Aromaticity by 37%; modeling predicts lower aromaticity, lower metals, less oxygen and lower NCR.

EXAMPLE 7

Arab light vacuum resid (ALVR) diluted in a organic solvent was selectively upgraded by oxidative ring opening using bleach (12% NaOCl in water) as oxidant in presence of $RuO_4$ catalyst. The uplift of the ALVR including a significant reduction in the metal content of the resid after the oxidative rign opening is shown in Table 3 below. Also, there is a selective reduction in aromatic 130C and 1H NMR demonstrating that the chemistry is highly selective towards selective ring opening of aromatic cores present in resids.

TABLE 3

| Feed | Arab Light Vacuum Resid (ALVR) | Oxidized Resid |
|---|---|---|
| C, wt % | 83.6 | 70.5 |
| H, wt % | 10.0 | 9.21 |
| S, wt % | 4.10 | 2.41 |
| N, wt % | 0.39 | 0.38 |
| O, wt % | 0.50 | 14.2 |
| Ni/V, ppm | 96.8/27.7 | 11.0/16.0 |
| Aromatic/Aliphatic C ($^{13}$C NMR) | 31.2/68.8 | 14.7/82.0 |
| Aromatic/Aliphatic C ($^1$H NMR) | 6.7/93.3 | 4.7/95.2 |

The oxidized resid was then blended with vacuum gas oil (VGO) in ratio of 10% oxidized resid and 90% VGO which was used as a feed for the FCC. FCC tests were carried out in the ACE (Advanced Catalyst Evaluation) unit which represents a lab scale FCCU. The base case feed to the ACE unit was 10% resid and 90% VGO blend.

The catalyst used in the ACE was 90% e-cat+10% bottoms cracking additive, temperature was 540° C. (1000° F.), Cat/Oil ratio 6.2 and time on stream 42 secs for a nominal 68% conversion in all cases. Potential benefits of using oxidative ring opening as a pre-treatment for resid before sending it to a FCCU is evident from the yield distributions obtained from the ACE unit which are shown in Table 4 below. Significant reductions in hydrogen and coke formation were observed when the oxidized resid was treated in FCC type riser.

TABLE 4

| Feed<br>Catalyst | 10% ALVR + 90% VGO | 10% Oxidized Resid + 90% VGO | Benefit of Oxidation | % Change |
|---|---|---|---|---|
| | 90% e-cat + 10% bottoms cracking additive | | | |
| Hydrogen | 0.23 | 0.11 | −0.12 | −53 |
| Methane | 0.93 | 0.73 | −0.2 | −22 |
| Ethane | 0.58 | 0.49 | −0.1 | −17 |
| Ethene | 0.74 | 0.77 | 0.03 | 4 |
| Propane | 1.25 | 1.23 | −0.02 | −2 |
| Propene | 4.58 | 4.79 | 0.21 | 5 |
| Butanes | 4.6 | 4.9 | 0.3 | 7 |
| Butenes | 4.8 | 4.9 | 0.1 | 2 |
| Dry gas | 2.5 | 2.1 | −0.4 | −15 |
| LPG | 15.2 | 15.8 | 0.6 | 4 |
| Naphtha | 42.1 | 44.6 | 2.5 | 6 |
| LCO | 20.9 | 20.5 | −0.4 | −2 |
| Bottoms | 11.7 | 11.7 | 0 | 0 |
| Coke | 7.6 | 5.3 | −2.3 | −30 |

The results above demonstrate that the resids are more reactive for cracking when they are upgraded by the partial oxidation and that conversion is increased by 15% after oxidation with 30% less coke. Yield improvements in hydrogen, drygas, and coke are noted with yields shifted to naphtha.

The invention claimed is:

1. A process of upgrading a heavy petroleum oil stream which comprises subjecting the heavy oil stream to selective partial oxidation with a catalytic oxidation system to partially oxidize aromatic ring systems in the heavy oil to improve its crackability and then cracking the partially oxidized oil to lower molecular weight cracking products by fluid catalytic cracking, hyrdrocracking, coking, or a combination thereof.

2. A process according to claim 1 in which the cracking of the partially oxidized oil is by fluid catalytic cracking.

3. A process according to claim 1 in which the cracking of the partially oxidized oil is by hydrocracking.

4. A process according to claim 1 in which the cracking of the partially oxidized oil is by coking.

5. A process according to claim 1 in which the catalytic oxidation system comprises a metal salt or a metal oxide as catalyst and a peroxy oxidant.

6. A process according to claim 1 in which the catalytic oxidation system comprises a ruthenium tetroxide and sodium periodate.

7. A process according to claim 1 in which the catalytic oxidation system comprises an aqueous solution of a metal salt as catalyst and an oxidant.

8. A process according to claim 1 in which the heavy oil stream comrpises a vacuum resid containing aromatic compounds of 3, 4 and 5-membered fused aromatic rings.

9. A process according to claim 8 in which 4 and 5-membered fused aromatic rings of the vacuum resid are oxidized to form 3 or fewer membered fused aromatic rings.

10. A process for reducing the boiling point range of a petroleum vacuum resid feed which comprises subjecting the resid feed to selective partial oxidation with a catalytic oxidation system to partially oxidize aromatic ring systems in the resid to improve its crackability and then cracking the partially oxidized oil in a fluid catalytic cracking process to lower molecular weight cracking products.

11. A process according to claim 10 in which the catalytic oxidation system comprises a ruthenium salt and a peroxy oxidant.

12. A process according to claim 10 in which the catalytic oxidation system comprises a ruthenium tetroxide and sodium periodate.

13. A process according to claim 10 in which the catalytic oxidation system comprises an aqueous solution of a metal catalyst and oxidant.

14. A process according to claim 10 in which the heavy oil stream comrpises a vacuum resid containing aromatic compounds of 3, 4 and 5-membered fused aromatic rings.

15. A process according to claim 14 in which 4 and 5-membered fused aromatic rings of the vacuum resid are oxidized to form 3 or fewer membered fused aromatic rings.

16. A process for reducing the boiling point range of a petroleum vacuum resid feed which comprises subjecting the resid feed to selective partial oxidation with a catalytic oxidation system to partially oxidize aromatic ring systems in the resid to improve its crackability and then cracking the partially oxidized oil in a hydrocracking process to lower molecular weight cracking products.

17. A process according to claim 16 in which the catalytic oxidation system comprises a ruthenium salt and a peroxy oxidant.

18. A process according to claim 17 in which the catalytic oxidation system comprises a ruthenium tetroxide and sodium periodate.

* * * * *